United States Patent [19]

Steiner

[11] Patent Number: 4,596,258

[45] Date of Patent: Jun. 24, 1986

[54] SMOKING DEVICES

[76] Inventor: Pierre G. Steiner, 417 Sea Ridge Dr., La Jolla, Calif. 92037

[21] Appl. No.: 611,941

[22] Filed: May 18, 1984

Related U.S. Application Data

[63] Continuation-in-part of Ser. No. 431,411, Sep. 30, 1982, Pat. No. 4,474,191.

[51] Int. Cl.[4] ..... A24D 5/04

[52] U.S. Cl. ..... 131/198.1; 131/195; 131/196; 131/200

[58] Field of Search ..... 131/329, 198 R, 200, 131/336, 271, 198 A, 195, 196, 335, 198.1, 198.2

[56] References Cited

U.S. PATENT DOCUMENTS

| | | | |
|---|---|---|---|
| 2,104,266 | 1/1938 | McCormick | 131/329 |
| 2,580,974 | 1/1952 | Sutter | 131/329 |
| 2,667,170 | 1/1954 | Lebert | 131/195 |
| 3,258,015 | 6/1966 | Ellis et al. | 131/329 |
| 3,270,751 | 9/1966 | Tucker | 131/198.1 |
| 3,324,861 | 6/1967 | Gaisman | 131/336 |
| 3,457,064 | 5/1976 | Mestre et al. | 131/329 |
| 3,496,946 | 2/1970 | Griffith | 131/329 |
| 3,503,406 | 3/1970 | Riegel et al. | 131/336 |
| 3,516,417 | 6/1970 | Moses | 131/271 |
| 3,519,000 | 7/1970 | Houser | 131/336 |
| 3,685,520 | 8/1972 | Chernack | 131/336 |
| 3,685,522 | 8/1972 | Kleinhans | 131/198.2 |
| 3,713,452 | 1/1973 | D'Elia et al. | 131/336 |
| 3,759,268 | 9/1973 | Plourde | 131/198.1 |
| 4,141,369 | 2/1979 | Burruss | 131/329 |
| 4,188,958 | 2/1980 | Whitford | 131/329 |
| 4,210,160 | 7/1980 | Wunsche | 131/329 |
| 4,303,083 | 12/1981 | Burruss | 131/329 |
| 4,327,748 | 5/1982 | Divis | 131/198.1 |

FOREIGN PATENT DOCUMENTS

| | | | |
|---|---|---|---|
| 1113979 | 5/1968 | United Kingdom | 131/335 |
| 2064296 | 5/1981 | United Kingdom | 131/335 |

*Primary Examiner*—V. Millin

*Attorney, Agent, or Firm*—Robbins & Laramie

[57] ABSTRACT

A smoking device is disclosed which allows the user to regulate the air he inhales to consist of pure tobacco smoke, pure air, pure air carrying volatile substances, or a mixture of tobacco smoke and air carrying volatile substances. This is accomplished by a smoking device having three air passages and means to selectively open and close these passages.

20 Claims, 12 Drawing Figures

SMOKING DEVICES

CROSS-REFERENCE TO RELATED APPLICATION

This application is a continuation-in-part of application Ser. No. 431,411, filed Sept. 30, 1982, now U.S. Pat. No. 4,474,191 which is incorporated herein by reference.

FIELD OF THE INVENTION

The instant invention relates to pipes, cigarettes, cigars and other smoking devices. More specifically, it relates to tobacco substitutes and to smoke-to-air ratio controlling apparatus.

BACKGROUND OF THE INVENTION

A parallel is often drawn between the consumption of alcohol and the smoking of tobacco to the effect that both habits are injurious to health and have cumulative toxic effects. There is, however, a significant difference between the two practices in that one is not required when imbibing alcohol to absorb at the same time additional harmful substances; while the tobacco smoker, in addition to the euphoric and sedative nicotine, must inhale a multiplicity of compounds in a large quantity which are highly toxic and totally devoid of any enjoyable physiological properties.

As early as 1964 the Report of the Advisory Committee to the Surgeon General of the Public Health Service published by the U.S. Department of Health, Education and Welfare stated at page 62 that "seven polycyclic compounds isolated from cigarette smoke have been established to be carcinogenic . . . . The over-all carcinogenic potency of tobacco tar is many times the effects which can be attributed to substances isolated from it. The difference may be associated in part with the presence in tobacco smoke of cocarcinogens, several of which have been identified as smoke components." At page 145 the report further states that "one hypothesis suggests that promoting agents present in tobacco and tobacco smoke, such as various phenols, enhance the potency of the carcinogenic hydro-carbons so as to account for the biological activity of the tobacco products. Further, possible synergism between low levels of the several non-carcinogens in the tobacco condensates and extracts may also enhance the carcinogenic potency." The report goes on inventorying other noxious products found in tobacco smoke such as pesticides used in the husbandry of tobacco in the United States, lactones and radioactive components. In an article published in the Los Angeles *Herald Examiner* of July 29, 1982, it is reported that the one and one-half pack-a-day smoker receives a yearly dose of alpha-radiation equivalent to 300 chest X-rays—a dose to the windpipe area of some eight rems of radiation per year. By contrast, the government standard for total body radiation exposure for nuclear power plant workers is only 5 rems per year.

One the other hand, the HEW report states at page 74 that "the effects of nicotine at dosage levels absorbed from smoking 0–2 milligrams (per inhaled cigarette) are comparatively small."

Countless attempts have been made over the last few years to reduce the tar content of smoking tobacco. Cigarette manufacturers commonly use comparative advertising showing the low-tar content of their product relative to others. By judicious use of filters and other techniques, the tar content of certain cigarettes has been reduced down to the relatively low level of one milligram per smoked cigarette. Unfortunately, these techniques tend also to reduce the amount of inhaled nicotine to approximately 0.1 milligram per cigarette—thus forcing the smoker to use more than one cigarette or to take a deeper breath and hold it longer in the lungs in order to achieve the same effect as the one obtained from an unfiltered cigarette. In other words, no one has found a way to completely eliminate the poison-loaded smoke inhalation inherent in the combustion of tobacco without reducing or even eliminating at the same time the pleasing sensations derived from smoking, which are mainly attributable to the nicotine intake. To make matters worse, the filtering process tends to remove the largest but least harmful particles, while letting pass through smaller ones which, because of their size tend to penetrate more deeply into the lung cells. Thus, we must face the paradox of an increase in the toxicity of cigarettes in proportion to the efficiency of the filtering process.

A new approach beyond the use of filters must be sought for making cigarette smoking safer but nevertheless enjoyable.

Another unpleasant characteristic of smoking pertains to the air-polluting effect and more specifically the inhalation of tobacco smoke by persons who find themselves in close proximity to the smoker in a confined environment. The side effect upon the non-smoker has been observed particularly among bartenders and waitresses who work long hours in poorly ventilated bars and restaurants. This problem has been only partially palliated by means of mechanical and electrostatic fan-driven filtering machines.

There have been some attempts to circumvent the deleterious effects of tobacco smoke by electronically heating the pipe bowl to a degree sufficient to volatize the nicotine and aromatic compounds held by the tobacco without inducing combustion. U.S. Pat. Nos. 2,104,266 and 4,141,369 disclose prime examples of this approach.

U.S. Pat. No. 4,303,083 suggests the use of a similar method for administrating volatile medications.

The contrivances can only be used in the proximity of an electrical power source. They are cumbersome to use. They look, handle, and operate in ways far different from the common smoking instrument to act as acceptable substitutes.

Several patents describe smoking devices which contain means for controlling the mixture of tobacco smoke and air. U.S. Pat. Nos. 3,270,751, 3,685,520, 3,503,406 and 3,713,452 illustrate the rotation of a mouthpiece to provide either mixtures of tobacco smoke and pure air or pure air alone, which are inhaled by the smoker.

U.S. Pat. Nos. 3,519,000, 3,685,522 and 4,327,748 illustrate valves as a means for controlling the air inhaled by the smoker.

SUMMARY OF THE INVENTION

The present invention provides a means for allowing a smoker to choose what is being inhaled, to adapt it to his health motivations, without having to fight against his habit to follow his physician's instructions. Thus, a smoker may inhale only tobacco smoke; a mixture of tobacco smoke and air containing nicotine; tobacco-stimulating aromatics and antidotal metabolites; only air containing nicotine, tobacco-stimulating aromatics and anidotal metabolites, or only pure air, with or without tobacco parfums. As a result he may completely eliminate the noxious inhalation of tar and other poison-carrying smoke by limiting the intake to purified nicotine, tobacco-simulating aromatics and antidotal metabolites. He may also completely eliminate the inhalation of nicotine, tobacco-simulating aromatics and antidotal metabolites by inhaling only pure air.

The nicotine, tobacco-simulating aromatics and antidotal metabolites are deposited in a volatile or sublimable form in the air-intake channel of a smoking device. This channel is completely isolated from the combustion chamber by a non-combustible but heat-conductive wall. The smoke from the combustion chamber is not allowed to enter this air-intake channel. The combustion itself is used to provide the heat necessary to volatize or sublime the substances.

Any concern for the nearby non-smoker can be eliminated by replacing the tobacco by a pleasant-smelling aerated cellulose-based combustible material, containing and surrounded by a tar absorbant like "carboadsorbons".

Smoking devices according to this invention may be implemented in various configurations. The air-intake channel can take the form of a chimney running through the center of a pipe bowl, a cigar or a cigarette. In an alternate configuration, the tobacco or substitute combustible material is held in a cupular chamber whose peripheral walls are surrounded by a series of channels converging toward the mouthpiece.

It is the principal object of this invention to provide a smoking device which enables the smoker to select various mixtures of air ranging from normal tobacco smoke, to pure nicotine with its antidotal tobacco parfums carrying air, or to pure air, with or without tobacco parfums.

Another object of this invention is to provide for the complete elimination of the inhalation of tar and other poison-carrying smoke, should the smoker so desire.

One advantage of this invention is that it provides a smoking device which has the appearance, taste and feel of the common pipe, cigarette or cigar, and which preserves all the enjoyable, physiological effects due to the intake of nicotine.

An additional advantage of this invention is that it provides a means for alleviating the discomfort suffered by non-smokers (called also "passive smokers") who find themselves in close proximity to a smoking individual in a confined environment.

A further advantage of this invention is that is improves the quality of the substances inhaled by the smoker by adding antidotal elements to the combination of purified nicotine and safe tobacco-simulating aromatics.

These and other advantages of the invention are achieved by means of any and all of the various devices disclosed below.

BRIEF DESCRIPTION OF THE DRAWINGS

Throughout the drawings, like reference numerals should be understood to represent like parts.

DETAILED DESCRIPTION OF THE PREFERRED EMBODIMENTS

Figure 1:
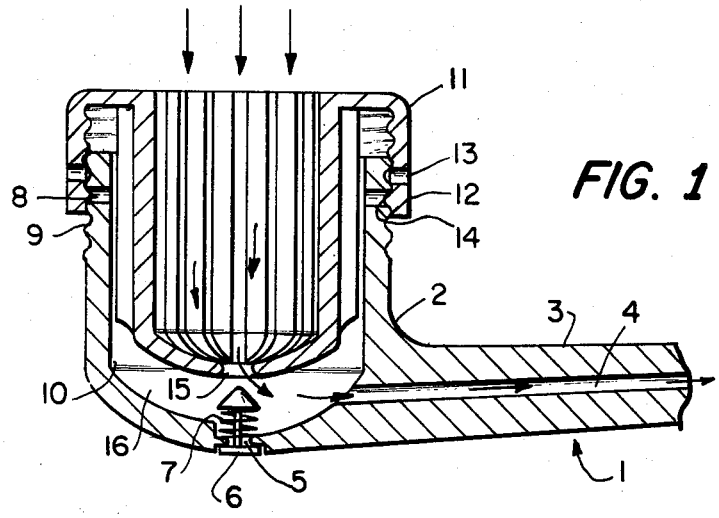
FIGS. 1 through 4 are longitudinal cross-sectional views of a smoking pipe embodiment constructed in accordance with the invention and showing the various stages for altering the source of inhaled air.

Referring now to the drawings, and specifically to FIGS. 1 through 4, a first embodiment of the invention will be described. This first embodiment comprises a smoking pipe 1 comprising a head 2 and a stem 3 which has a stem conduit 4. The head 2 has a hole 5 at its bottom in which is inserted a metallic pipe-head obturator 6 having a spring 7. The pipe head 2 further contains a series of holes 8 and screw-like threads 9 around its crown, and has an interior wall 10.

The head 2 further comprises a disposable, fire-resistant and heat-conductive bowl 11 which is inserted in the head 2. The bowl 11 is rimmed by a flange overlap 12 having a series of peripheral holes 13 which match the holes 8 in the crown of the head 2. The flange overlap 12 also contains a thread projection 14 which can be threaded over the screw-like threads 9 of head 2. The level of bowl 11 in head 2 is adjusted by threading the projections 14 over threads 9. A hole 15 at the bottom of bowl 11 corresponds to obturator 6. A bottom space 16 is provided between the bottom of bowl 11 and the bottom of head 2 when bowl 11 is in an elevated position as shown. A side space **16*a* also exists between head 2 and bowl 11 when the bowl 11 is inserted into the head 2. The construction of bowl 11** is more fully described in copending application Ser. No. 431,411, filed 9-30-82, incorporated herein by reference.

Volatile and sublimable substances which will vaporize when the bowl 11 is heated are impregnated in the porous surface of its outside walls. These substances are chosen to smell, taste and act as would burning tobacco. They include nicotine, tobacco-smelling or tobacco-tasting aromatics and antidotal metabolites such as niacinamid. The location of these substances is more fully described in copending application Ser. No. 431,411. These substances are vaporized by the heat of combustion of the burning tobacco or tobacco substitute.

With reference to FIGS. 1 through 4, this pipe embodiment can be used as follows. It will be seen that the smoker is presented with four choices of inhaled air. In FIG. 1, the user screws the bowl 11, which is filled with tobacco, one-fourth of the way into pipe head 2. In this position, peripheral holes 13 and crown holes 8 are not aligned and obturator 6 closes bottom hole 5. As a result, air is drawn only through the burning tobacco and passes through hole 15 and through stem conduit 4 to the user. In this position, pure tobacco smoke is inhaled.

Figure 2:
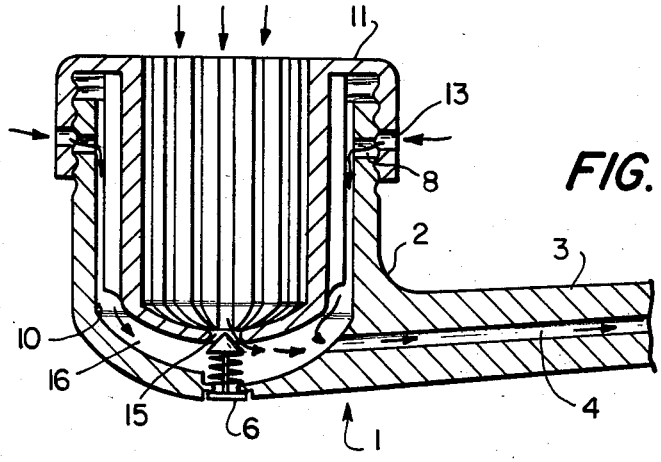

In FIG. 2, the user screws the bowl 11 another one-fourth of the way into head 2. In this position, peripheral holes 13 are partially aligned with crown holes 8 and obturator 6 partially closes hole 15 of bowl 11 and still completely closes bottom hole 5. As a result, tobacco smoke which passes through hole 15 and air carrying vaporized nicotine and other substances which passes through side space **16*a* are mixed in bottom space 16 and inhaled through stem conduit 4** by the user.

Figure 3:
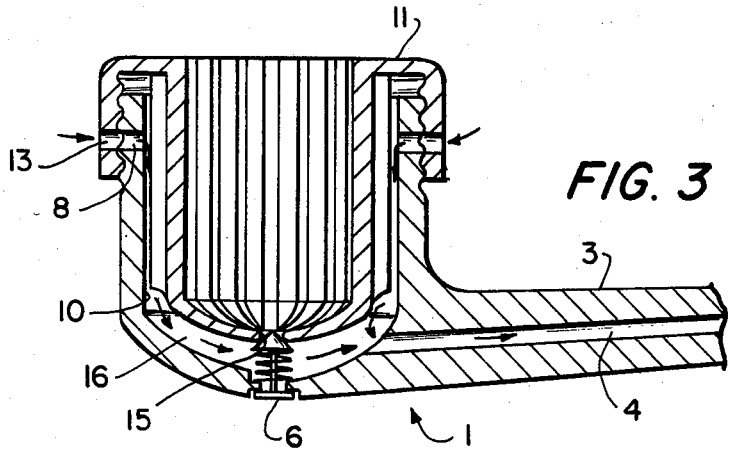

In FIG. 3, the user screws bowl 11 another one-fourth of the way into head 2. In this position, peripheral holes 13 are completely aligned with crown holes 8 and obturator 6 completely closes hole 15 of bowl 11 and bottom hole 5. As a result, tobacco smoke is prevented from passing through hole 15, and only air carrying vaporized nicotine and other substances passes through side space 16a and bottom space 16 and is inhaled by the user through the stem conduit 4.

Figure 4:
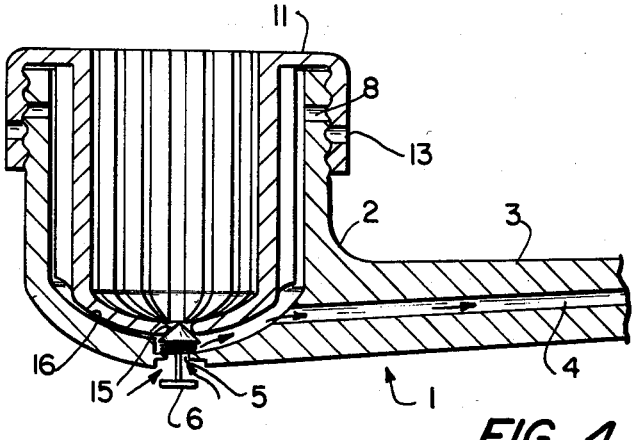

In FIG. 4, the user screws bowl 11 fully into head 2. In this position, peripheral holes 13 are not aligned with crown holes 8 and obturator 6 still completely closes hole 15 of bowl 11. However, the obturator 6 is now pushed below head 2 against the force of the spring, opening bottom hole 5. As a result, only pure, exterior air is drawn through the stem conduit 4 by the user.

A second embodiment is shown in FIGS. 5 through 8 and represents a cigarette or cigar embodiment. A cigarette or cigar shown as 17 comprises a cigarette (or cigar) body 18 and a mouthpiece 19. Body 18 has an end 20 which is adjacent mouthpiece 19, a central chimney 21 having an end 22, and a central tube 21a. The construction of the body 18 and chimney 21 is more fully described in copending Serial No. 431,411, incorporated herein by reference. As described therein, the chimney 21 may be comprised of a single section or of several small sections bonded together. Nicotine and other substances are impregnated in the inside walls of the chimney as described in copending Serial No. 431,411 and are vaporized by the heat of combustion of the tobacco. Toward the end 20 of body 18 and behind chimney 21 can be found screw-like threads 23 and holes 24 in the central tube 21a. Tobacco 25 is packed around chimney 21 and central tube 21a, inside the walls of body 18.

Mouthpiece 19 has a central tube 26 which extends into body 18 and an exterior tube 26a which overlaps body 18. Exterior tube 26a contains peripheral holes 27. Central tube 26 contains holes 28 and 28a, thread projections 29, and end holes 30 aligning with the edges of the chimney 21.

Figure 5:
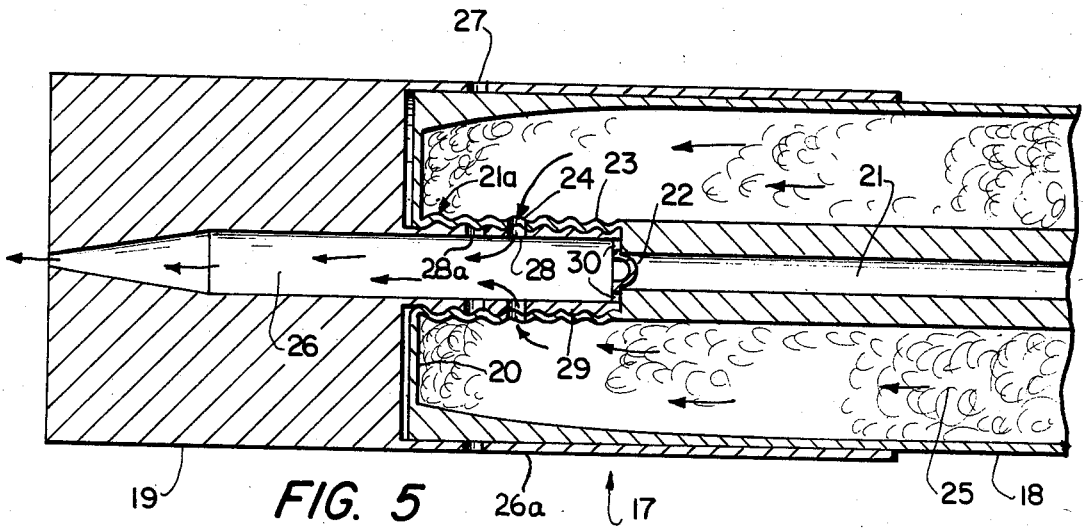
FIGS. 5 through 8 are longitudinal cross-sectional views of a cigarette or cigar constructed in accordance with the invention and showing the various stages for altering the source of inhaled air.

With reference to FIGS. 5 through 8, the cigarette or cigar embodiment is utilized as follows. As with the pipe embodiment, the user has four choices of air to be inhaled. In FIG. 5, the user screws the mouthpiece 19 completely into body 18. In this position, holes 27, 28a and 30 are closed. However, holes 24 and 28 are aligned. As a result, air is drawn only through the burning tobacco and passes through mouthpiece central tube 26 to the user. In this position, pure tobacco smoke is inhaled.

Figure 6:
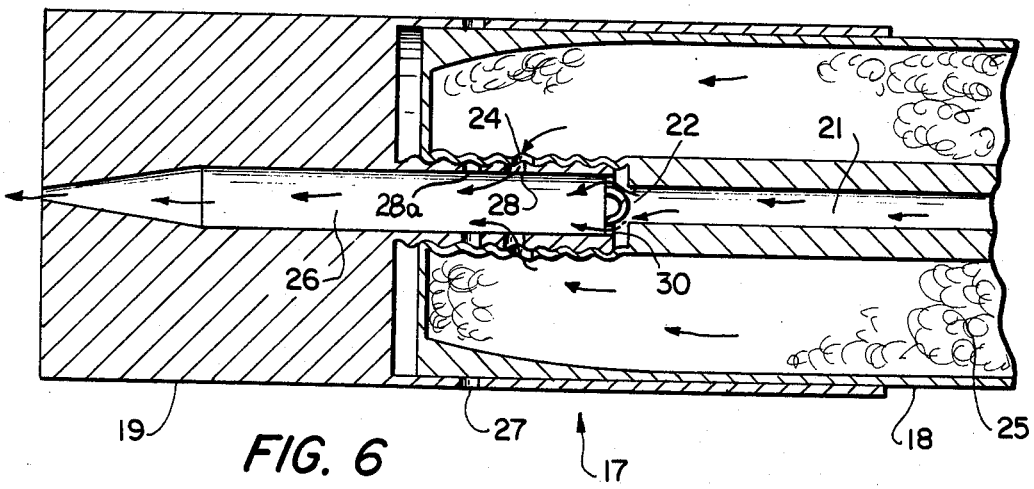

In FIG. 6, the user unscrews mouthpiece 19 one-fourth of the way out of body 18. In this position, holes 27 and 28a are closed. Holes 24 and 28 are now partially aligned and end holes 30 are now open. As a result, tobacco smoke which passes through holes 24 and 28 into mouthpiece central tube 26 and air carrying vaporized nicotine and other substances which passes through chimney 21 and end holes 30 into mouthpiece central tube 26 are mixed and inhaled by the user.

Figure 7:
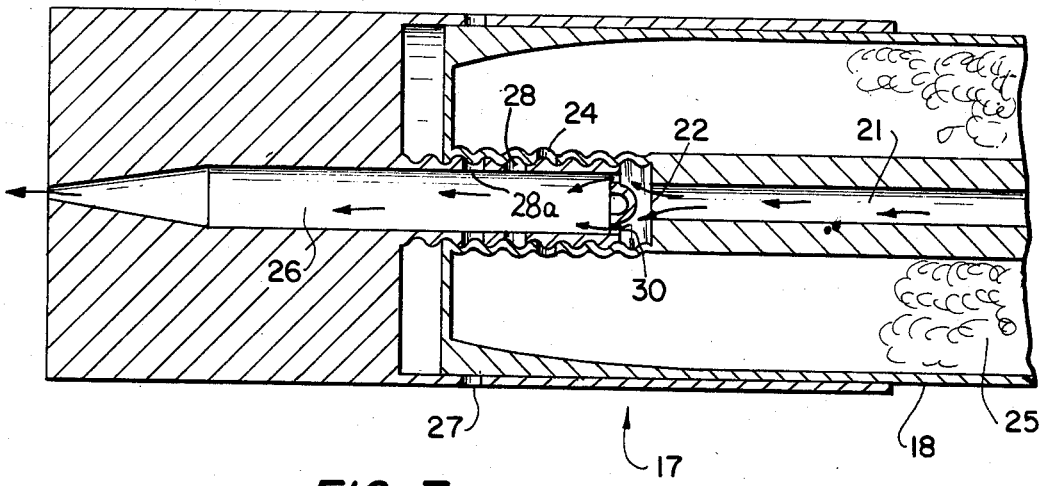

In FIG. 7, the user unscrews mouthpiece 19 from body 18 by another one-fourth. In this position holes 24, 27, 28 and 28a are closed and only end holes 30 are open. As a result, tobacco smoke is prevented from entering mouthpiece central tube 26 and only air carrying vaporized nicotine and other substances passes through chimney 21 and end holes 30 into mouthpiece central tube 26 to be inhaled by the user.

Figure 8:
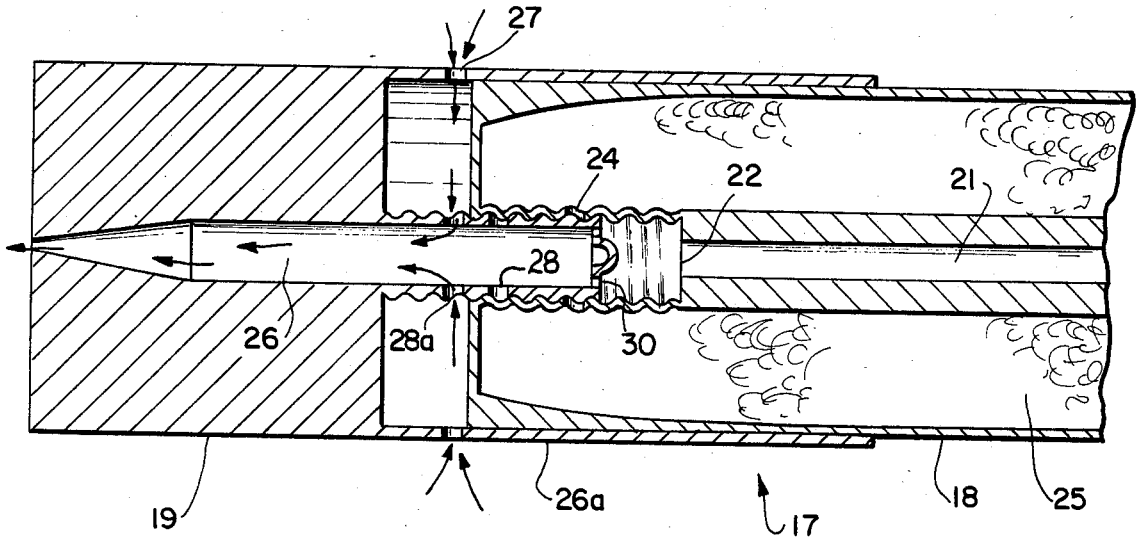

In FIG. 8, the user unscrews mouthpiece 19 an additional one-fourth of the way from body 18. In this position, holes 24 and 28 are closed and holes 27, 28a and end holes 30 are open. Since there are many peripheral holes 27 which are collectively larger than end holes 30, and since the strength of a puff is limited, only pure, exterior air will be drawn into mouthpiece central tube 26 and inhaled by the user; at this point the smoker can even unscrew entirely body 18 and get rid of it.

A third embodiment directed to a second design for a pipe is shown in FIGS. 9 through 12. A pipe 31 comprises a head having an upper half 32 and a lower half 32a, and a stem 33 having a stem conduit 34. The lower head half 32a has peripheral holes 35 and both halves 32 and 32a are threaded so they may be screwed together. Lower head half 32a further has an upstanding central tube 36 having side holes 37 and 38 and end holes 39. The central tube is also threaded.

The pipe 31 further comprises a disposable tobacco load 40 which is constructed similar to the cigarette (or cigar) body 18 described above. Tobacco load 40 has an exterior wall 41, an internal channel 42 which is threaded and contains holes 43, and a central chimney 44 having an end 45. The tobacco load 40 is packed with tobacco 46. The end holes 39 of upstanding central tube 36 belonging to the lower head 32a align with the edges of the central chimney 44.

Figure 9:
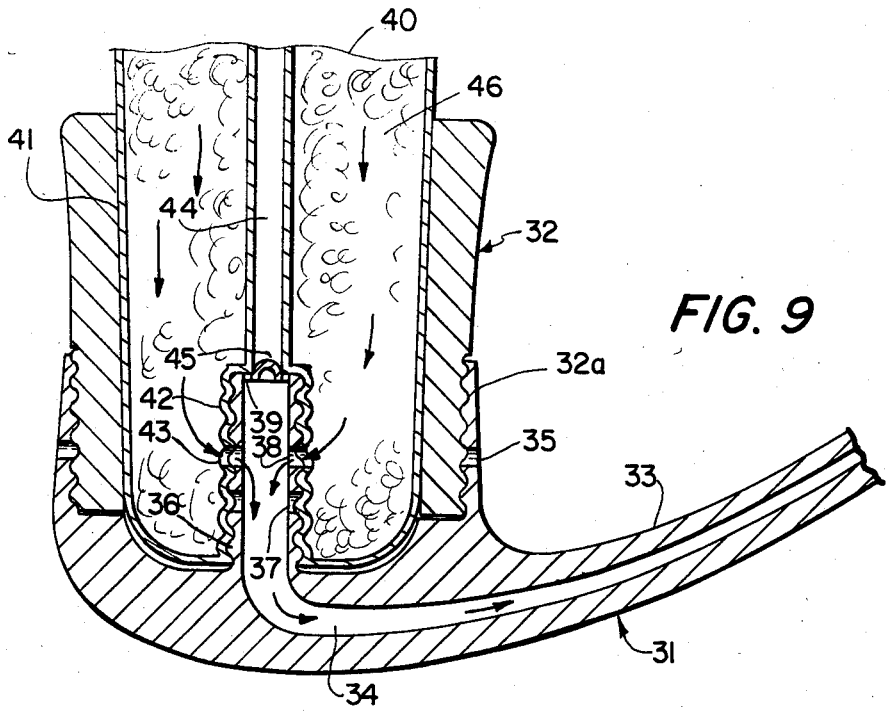
FIGS. 9 through 12 are longitudinal cross-sectional views of a second smoking pipe embodiment constructed in accordance with the invention and showing the various stages for altering the source of inhaled air.

This pipe embodiment can be utilized as follows, with reference to FIGS. 9 through 12. As previously mentioned, the user has a choice of inhaled air. In FIG. 9, tobacco load 40 is inserted into upper head half 32 and the composite is fully screwed into lower head half 32a. In this position, peripheral holes 35, side holes 37 and end holes 39 are closed. Holes 38 and 43 are completely aligned. As a result, air is drawn only through the burning tobacco and passes through central tube 36 to stem conduit 34 to be inhaled by the user. In this position, only pure tobacco smoke is inhaled.

Figure 10:
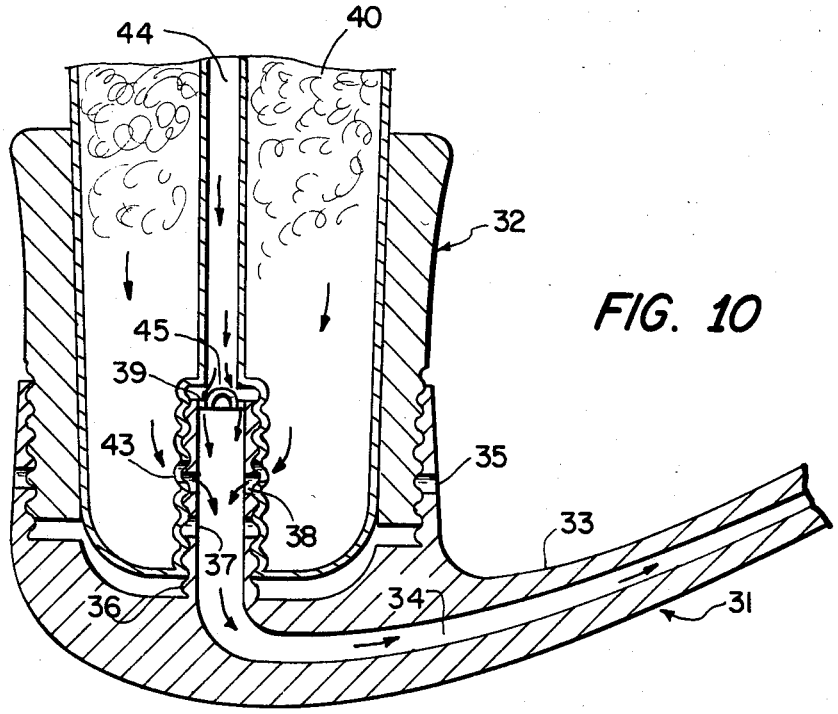

In FIG. 10, the upper head half 32 is unscrewed one-fourth of the way out of lower head half 32a. In this position, peripheral holes 35 and side holes 37 are closed. Holes 38 and 43 are now partially aligned and end holes 39 are open since they are separated from the edges of the central chimney 44. As a result, tobacco smoke which passes through holes 38 and 43 into central tube 36 and air carrying vaporized nicotine and other substances which passes through chimney 44 and end holes 39 into central tube 36 are mixed and passed through stem conduit 34 to be inhaled by the user.

Figure 11:
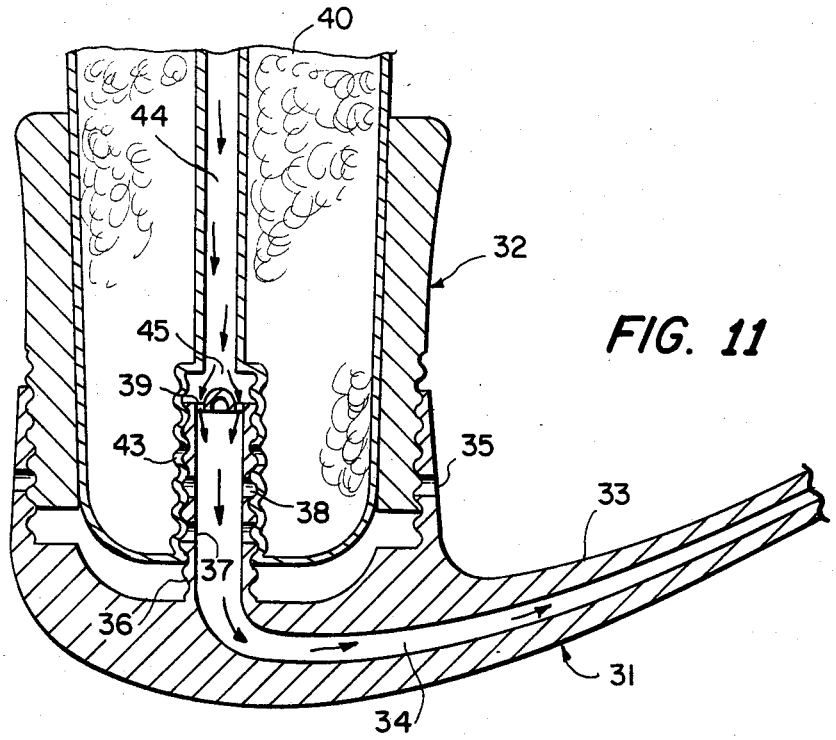

In FIG. 11, the user unscrews the upper head half 32 by another one-fourth. In this position, peripheral holes 35 and holes 37, 38 and 43 are closed. Only end holes 39 are open. As a result, tobacco smoke is prevented from entering central tube 36 and only air carrying vaporized nicotine and other substances passes through chimney 44 and end holes 39 into central tube 36 to be inhaled by the user.

Figure 12:
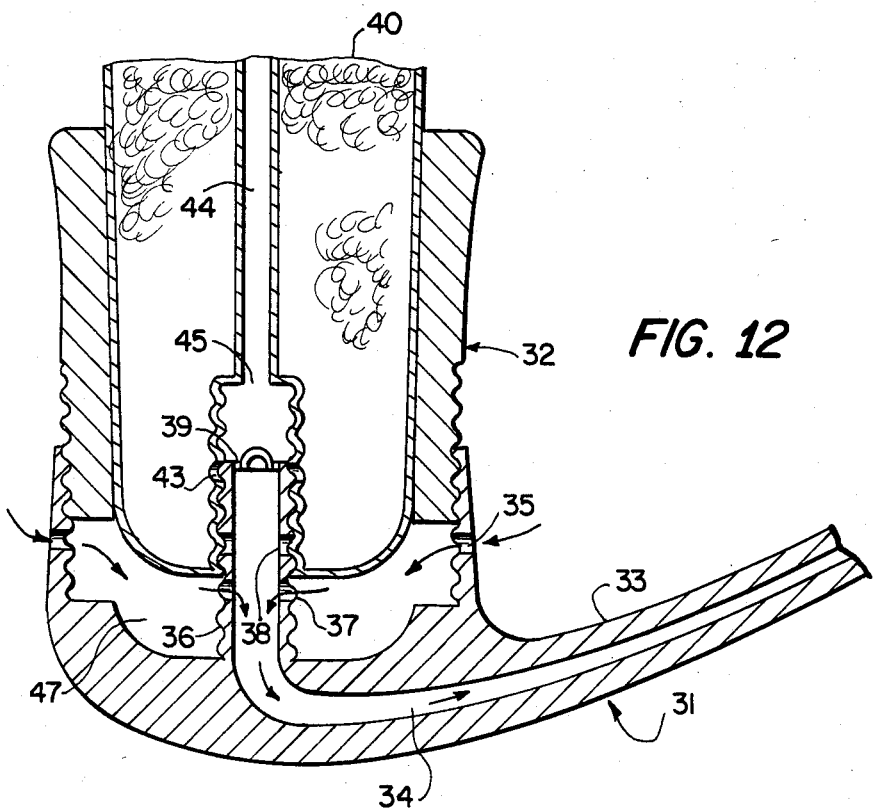

In FIG. 12, the upper head half 32 is unscrewed from the lower head half 32a by an additional one-fourth. In this position, peripheral holes 35, side holes 37 and end holes 39 are open. Holes 38 and 43 are closed. An air passage 47 is present between tobacco load 40 and lower head half 32a. Since there are many peripheral holes 35 which are collectively larger than end holes 39, and since the strength of a puff is limited, only pure, exterior air enters central tube 36 through peripheral holes 35, passage 47 and holes 37. Thus pure air is inhaled by the user.

The two separate head parts 32 and 32a are designed only to facilitate the cleaning of the pipe, but they can be made in one piece, thus looking like an ordinary pipe head. In this case, the exterior wall 41 of tobacco load 40 would close peripheral holes 35, until the tobacco load would be unscrewed its last fourth, as described above with reference to FIGS. 9–12.

At this stage this smoker can also, if he wishes, unscrew entirely his tobacco load 40 and get rid of it, but still continue his habit of puffing regularly at his pipe, and enjoy a nice scent, if the external surface of the bottom wall of the tobacco load 40 is impregnated with tobacco parfums.

While the invention has been disclosed in the present application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

What is claimed is:

1. A smoking device which comprises:

a combustion chamber capable of holding a combustible material;

a mouthpiece;

an air intake conduit connected to said mouthpiece, said conduit having an area contiguous to said combustion chamber but separated from it by a heat-conductive wall shaped and dimensioned to be capable of preventing smoke generated in said combustion chamber from entering said conduit and said mouthpiece;

at least one aperture in said wall shaped and positioned to be capable of allowing passage of smoke between the combustion chamber and said conduit;

means for opening and closing said aperture, such that when said aperture is open, smoke passes between the combustion chamber and the conduit; when said aperture is in an intermediate position, a mixture of smoke and air from said conduit passes to said mouthpiece; and when said aperture is closed, smoke is prevented from passing between the combustion chamber and the conduit; and volatile substances held within said area.

2. The smoking device of claim 1 wherein said volatile substances comprise nicotine.

3. The smoking device of claim 2 wherein said volatile substances further comprise aromatics.

4. The smoking device of claim 1 wherein said area comprises first elements in close proximity with said combustion chamber, said first elements carrying the least volatile of said substances, and second elements more distal from said combustion chamber, said second elements carrying the most volatile of said substances.

5. A smoking device which comprises:

a combustion chamber capable of holding a combustible material;

a mouthpiece having means to form a first air passage communicating directly with exterior air;

said combustion chamber and said mouthpiece having means to form a second air passage between them;

an air-intake conduit connected to said mouthpiece, said conduit having an area contiguous to said combustion chamber but separated from it by a heat-conductive wall;

volatile substances held within said area;

said mouthpiece and said air-intake conduit having means to form a third air passage between them; and means for selectively opening and closing said air passages, whereby said first air passage may be opened and said second and third air passages may be closed to admit only pure air to said mouthpiece, or said second air passage is open and said first and third air passages are closed to admit only smoke from said combustible material to said mouthpiece, or said third air passage is open and said first and second air passages are closed to admit only air carrying volatile substances to said mouthpiece, or said second and third air passages are each partially open and said first air passage is closed to admit a mixture of smoke and air carrying volatile substances to said mouthpiece.

6. The smoking device of claim 5 wherein said volatile substances comprise nicotine.

7. The smoking device of claim 6 wherein said volatile substances further comprise aromatics.

8. The smoking device claimed in claim 5 wherein said area comprises first elements in close proximity with said combustion chamber, said first elements carrying the least volatile of said substances, and second elements more distal from said combustion chamber, said second elements carrying the most volatile of said substances.

9. The smoking device claimed in claim 5 wherein the combustion chamber side of said wall is furrowed by a plurality of grooves shaped and dimensioned to aerate said combustion chamber.

10. The smoking device of claim 5 wherein said air-intake conduit comprises a plurality of short sections joined together with a heat-sensitive bond.

11. The smoking device claimed in claim 10 wherein each section comprises heat-absorbing areas projecting into said chamber; and further comprising heat dissipating areas projecting into said conduit.

12. The smoking device of claim 5 wherein said means for selectively opening and closing said air passages include screw-like threads.

13. The smoking device of claim 12 wherein said means for selectively opening and closing said air passage further includes a spring-loaded obturator.

14. The smoking device of claim 5 wherein said means for forming said first, second and third air passages are holes.

15. A smoking pipe which comprises:

a head;

a stem having a channel therethrough in communication with said head;

a separable, heat-resistant bowl inserted within said head and capable of holding a combustible material;

volatile substances applied on the outside walls of said bowl;

said bowl having means to form a first air passage which is between said bowl and said stem, said bowl and said head having means to form a second air passage which goes past the volatile substance and is between them and said stem, said head having means to form a third air passage communicating directly with exterior air; and means for selectively opening and closing said air passages, whereby said first air passage may be opened and said second and third air passages may be closed to admit only smoke from said combustible material, or said second air passage is open and said first and third air passages are closed to admit only air carrying volatile substances to said mouthpiece, or said third air passage is open and said first and second air passages are closed to admit only pure air to said mouthpiece, or said second and third air passages are each partially open and said first air passage is closed to admit a mixture of smoke and air carrying volatile substances to said mouthpiece.

16. The smoking pipe of claim 15 wherein said volatile substances comprise nicotine.

17. The smoking pipe of claim 16 wherein said volatile substances further comprise aromatics.

18. The smoking pipe of claim 15 wherein said means for selectively opening and closing said air passages include screw-like threads and a spring-loaded obturator.

19. The smoking pipe of claim 15 wherein said means for forming said first, second and third air passages are holes.

20. The smoking pipe of claim 19 wherein said hole forming said third air passage further has an obturator.

* * * * *